US006587089B1

(12) United States Patent
Nakajima

(10) Patent No.: US 6,587,089 B1
(45) Date of Patent: Jul. 1, 2003

(54) LCD PANEL AND LCD DEVICE EQUIPPED THEREWITH

(75) Inventor: Keiichi Nakajima, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/518,797

(22) Filed: Mar. 3, 2000

(30) Foreign Application Priority Data

Mar. 4, 1999 (JP) ..... 11-056848

(51) Int. Cl.[7] ..... G09G 3/36
(52) U.S. Cl. ..... 345/99; 345/87
(58) Field of Search ..... 345/87, 94, 19, 345/99; 365/210

(56) References Cited

U.S. PATENT DOCUMENTS 4,750,813 A * 6/1988 Ohwada et al. ..... 345/87
5,132,931 A * 7/1992 Koker ..... 365/210

FOREIGN PATENT DOCUMENTS

| | | |
|---|---|---|
| JP | 64-29899 | 1/1989 |
| JP | 6-317807 | 11/1994 |
| JP | 8-110765 | 4/1996 |
| JP | 9-211420 | 8/1997 |
| JP | 63-261389 | 10/1998 |
| JP | 11-265172 | 9/1999 |

* cited by examiner

*Primary Examiner*—Steven Saras
*Assistant Examiner*—Uchendu O. Anyaso
(74) *Attorney, Agent, or Firm*—Foley & Lardner

(57) ABSTRACT

An LCD panel is provided, which makes it possible to optimize the timing to write pixel data into LC cells without using any timing controller. This panel is comprised of (a) a first plurality of signal lines extending along rows of a matrix and arranged along columns of the matrix; (b) a second plurality of signal lines extending along the columns and arranged along the rows; (c) LC cells arranged in an array of the matrix; (d) driving elements for driving the respective LC cells; and (e) a signal delay line for generating a temporal delay in a timing control signal; the signal delay line extending along the rows and formed not to be electrically connected to the driving elements; the signal delay line having a first end into which the timing control signal is inputted and a second end from which the timing control signal containing the delay it outputted. Each of the first plurality of signal lines is used for supplying a selection signal to the driving elements located in a corresponding one of the rows Each of the second plurality of signal lines is used for supplying a data signal to the driving elements located in a corresponding one of the columns. The timing control signal containing the delay is used for timing control of supplying the data signals to the driving elements located in the corresponding columns through the second plurality of signal lines.

9 Claims, 5 Drawing Sheets

LCD PANEL AND LCD DEVICE EQUIPPED THEREWITH

BACKGROUND OF THE INVENTION

1. Field of the Invention

The present invention relates to a Liquid-Crystal Display (LCD) panel having a pair of transparent substrates and a Liquid-Crystal (LC) layer. sandwiched between the pair of substrates, in which driving elements such as Thin-Film Transistors (TFTs) and Metal-Insulator-Metal (MIM) elements are arranged regularly on one of the pair of substrates, and an LCD device formed by using the panel. More particularly, the present invention relates to an LCD panel and an LCD device of the active-matrix addressing type that are applicable to compact, light-weight display devices with a comparative wide display area and that are capable of displaying images in different modes or aspects of resolution, which are typically used for electronic equipment, such as various portable or non-portable display terminals.

2. Description of the Prior Art

FIGS. 1 and 2 schematically show the configuration and operation of a prior-art LCD device of this sort, respectively.

The prior-art LCD device of FIG. 1 has a TFT panel 120 including a plurality of LC cells 105 arranged in a matrix array having m rows and U columns, a drain driver 107 for driving the panel 120, and a gaze driver 108 for driving the same, where m and n are positive integers greater than unity. The first to m-th rows of the matrix extend along the X axis in FIG. 1 and arranged along the Y direction in FIG. 1 at equal intervals. The first to n-th columns of the matrix extend along the Y axis and arranged along the X direction at equal intervals.

A TFT 102 is formed in each of the plurality of LC cells 105. Each cell 105 serves as a capacitor along with a display electrode (not shown) and a common electrode (not shown). Thus, the cell 105 is illustrated in FIG. 1 by a symbol of a capacitor. Each cell 105 corresponds to a pixel of the LCD device.

While the display electrodes are formed on the inner surface of a transparent glass substrate 101 along with the TFTs 102, the common electrodes are formed on the inner surface of another transparent glass substrate (not shown) that is coupled with the substrate 101 to be opposed thereto. Needless to say, a LC layer is formed in the space between the substrate 101 and the opposing substrate.

On the inner surface of the substrate 101, first to m-th gate lines 128-1, 128-2, . . . , and 128-m, first to n-th drain lines 127-1, 127-2, . . . , and 127-n, and the TFTs 102 are formed. The m gate lines 128-1 to 128-m extend respectively along the m rows of the matrix. The n drain lines 127-1 to 127-n extend respectively along the n columns of the matrix. The TFPTs 102 are located at the respective intersections of the gate lines 128-1 to 128-m and the drain lines 127-1 to 127-n. Thus, the total number of the TFTs 102 is equal to (m×n).

The gate lines 128-1 to 128-m, which are parallel to each other, are electrically connected to the gate driver 108 located outside the substrate 101. The drain lines 127-1 to 127-n, which are parallel to each other and perpendicular to the gate lines 128-1 to 128-m, are electrically connected to the drain driver 107 located outside the substrate 101.

Each of the n drain lines 127-1 to 127-n is electrically connected to the drain electrodes D of the TFTs 102 that are aligned along the corresponding drain line 127-1, 127-2, . . . , or 127-n (i.e., the corresponding column of the matrix). Each of the m gate lines 128-1 to 128-m is electrically connected to the gate electrodes G of the TFTs 102 that are aligned along the corresponding gate line 128-1, 128-2, . . . , or 128-m (i.e., the corresponding row of the matrix).

The source S of each of the TFTs 102 is electrically connected to one of the two electrodes forming the corresponding LC cell 105 (i.e., the corresponding display electrode) formed on the substrate 101. The other electrodes of the cells 105 (i.e., the common electrode) are electrically connected to a common voltage source, such as the ground.

The gate driver 108 is applied with a vertical start signal VSP0 and a vertically-shifting clock signal VCK0. In response to the signals VSP0 and VCK0, the gate driver 108 generates selection signals VG1, VG2, . . . , and VGm to select a corresponding one of the rows of the matrix and then, supplies them to the corresponding gate lines 128-1, 128-2, . . . , and 128-m, respectively.

The drain driver 107 is applied with an image signal DAT0, a horizontal start signal HSP0, a horizontally-shifting clock signal HCK0, and a latch signal LP0. In response to the signals DAT0, HSP0, HCK0, and LP0, the drain driver 107 generates pixel data signals HD1, HD2, . . . , and HDn to form images and then, supplies them to the corresponding drain lines 127-1 to 127-n, respectively The supply or input of the pixel data signals HD1 to HDn is controlled by the latch signal LP0.

The prior-art LCD device shown in FIG. 1 operates in the following way.

The application of the horizontal start signal HSP0 to the drain driver 107 triggers off the input of the image signal DAT0 for one of the m rows of the matrix into the driver 10?. The input of the image signal DAT0 is performed to be synchronized with the application of the horizontally-shifting clock signal HCK0. Based on the applied image signal DAT0, the drain driver 107 generates the pixel data signals HD1 to HDn for one of the m rows of the matrix and then, supplies them simultaneously to the drain lines 127-1 to 127-n with specific timing, respectively.

On the other hand, the application of the vertical start signal VSP0 to the gate driver 108 triggers off the generation of the selection signals VG1 to VGm. Then, the driver 108 sequentially supplies the selection signals VG1 to VGm to the gate lines 128-1 to 128-m, respectively. As shown in FIG. 2, each of the signals VG1 to VGm contains a pulse and therefore, the TFTs 102 applied with the signal VG1, VG2, . . . , or VGm at their gate electrodes are turned on. Through the TFTs 102 thus turned on, the drain lines 127-1 to 127-n are electrically connected to the corresponding LCD cells 105, thereby selecting the cells 105 arranged along one of the m rows of the matrix. Since the pulses of the signals VG1 to VGm are successively shifted in phase to each other, the cells 105 arranged along each of the first to m-th rows of the matrix are successively selected.

The pixel data signals HD1 to HDn are respectively supplied to the selected cells 105 located in the selected rows of the matrix and then, the pixel data contained in the signals HD1 to HDn are written thereinto. Thus, the cells 105 are driven by the signals HD1 to HDn, thereby displaying images on the screen of the prior-art LCD device corresponding to the pixel data thus written.

Typically, the selection signals VG1 to VGm have waveforms A1 to Am denoted by the solid lines in FIG. 2 at the input ends 128-1A to 128-mA of the gate lines 128-1 to 128-m, respectively. On the other hand, the signals VG1 to VGm have waveforms B1 to Bm denoted by the broken lines in FIG. 2 at the output ends 128-1B to 128-mB of the lines 128-1 to 128-m, respectively. It is seen from FIG. 2 that each of the waveforms Bl to Bm includes obtuse rising and falling edges at the output ends 128-1B to 128-mB. The obtuse rising and falling edges of the waveforms Bl to Bm will cause some temporal shift in or phase delay $\Delta t_0$ of the waveforms Al to Am The shift or delay $\Delta t_0$ has been known as the "gate line delay", which is induced by the resistance of the lines 128-1 to 128-m and parasitic capacitances existing near the lines 128-1 to 128-m.

Accordingly, the supply timing of the pixel data signals HD1 to HDn needs to be properly adjusted while taking the "gate line delay" $\Delta t_0$ into consideration. If not so, the pixel data contained in the signals HD1 to HDn are unable to be correctly written into all the corresponding LC cells 105.

For example, as shown in FIG. 2, it is supposed that the writing operation of the pixel data from the signals HD1 to HDn for the first row of the matrix into the corresponding cells 105 is started at the time TA1. At this time, the selection signal VG1 rises at the input end 128-1A of the gate line 128-1. Then, the writing operation of the pixel data in the signal HD1 to HDn for the second row of the matrix into the corresponding cells 105 is started at the time TA2. In this case, all the TFTs 102 connected to the gate line 128-1 are not turned off and consequently, there arises a problem that the pixel data contained in the signals HD1 to HDn for the second row are written into the corresponding cells 105 located in the first row.

To prevent this problem, in the prior-art LCD device shown in FIG. 1, the vertically-shifting clock signal VCK0 is supplied to the gate driver 108 so as to be forward-shifted in phase by a period $\Delta t_0'$ with respect to the latch signal LP0, where the period $\Delta t_0''$ is equal to the gate line delay $\Delta t_0$. In other words, the gate line delay $\Delta t_0$ is compensated by giving the time difference $\Delta t_0'$ ($=\Delta t_0$) between the signals VCK0 and LP0. Due to this compensation, the pixel data signals HD1 to HDn are supplied to the drain lines 127-1 to 127-n at the delayed times TB1 to TBm, respectively. As a result, the pixel data contained in the signals HD1 to HDn can be correctly written into all the cells 105.

The period or time difference $\Delta t_0'$ between the signals VCK0 and LP0 is generated by a timing controller (not shown) that controls the drain driver 107 and the gate driver 108. The time difference $\Delta t_0'$ is produced by counting the number of the pulses of the horizontally-shifting clock signal HCK0 up to a specific value.

In general, when LCD devices are designed to be applicable to several different modes or aspects of resolution (i.e., different numbers of the pixels to be used), the pulse length of the horizontally-shifting clock signal HCK0 needs to vary according to the selected mode or aspect of resolution. From the point of view, the number of the pulses of the signal HCK0 needs to have different values according to the required different pulse-lengths. Thus, there arises a problem that the configuration of the timing controller is complicated and the dimensions thereof is expanded.

Another prior-art LCD device of this sort is disclosed in the Japanese Non-Examined Patent Publication No. 63-261389 published in 1988. In this device, the writing operation of the pixel data into the LC cells is delayed with respect to the vertically-shifting clock signals by using an analog delay circuit provided outside the TFT panel.

In the prior-art LCD device disclosed in the Publication No. 63-261399, however, an integrator circuit formed by a resistor or resistors and a capacitor or capacitors and a Schmitt trigger amplifier are required to be provided outside the TFT panel. Thus, there is a problem that the configuration of the driver circuits of the TFT panel is complicated and the number of necessary electronic parts or components is difficult to be reduced.

SUMMARY OF THE INVENTION

Accordingly, an object of the present invention is to provide an LCD panel and an LCD device that make it possible to optimize the timing to write pixel data into LC cells without using any timing controller.

Another object of the present invention is to provide an LCD panel and an LCD device that simplify the configuration of driver circuits.

The above objects together with others not specifically mentioned will become clear to those skilled in the art from the following description.

According to a first aspect of the present invention, an LCD panel is provided, which is comprised of (a) a first plurality of signal lines extending along rows of a matrix and arranged along columns of the matrix;

(b) a second plurality of signal lines extending along the columns of the matrix and arranged along the rows of the matrix;

(c) LC cells arranged in an array of the matrix;

(d) driving elements for driving the respective LC cells; and (e) a signal delay line for generating a temporal delay in a timing control signal;

the signal delay line extending along the rows of the matrix and formed not to be electrically connected to the driving elements;

the signal delay line having a first end into which the timing control signal is inputted and a second end from which the timing control signal containing the delay is outputted.

Each of the first plurality of signal lines is used for supplying a selection signal to the driving elements located in a corresponding one of the rows of the matrix. Each of the second plurality of signal lines is used for supplying a data signal to the driving elements located in a corresponding one of the columns of the matrix.

The timing control signal containing the delay is used for timing control of supplying the data signals to the driving elements located in the corresponding columns of the matrix through the second plurality of signal lines.

With the LCD panel according to the first aspect of the present invention, the signal delay line extending along the rows of the matrix (i.e., the first plurality of signal lines) is provided for generating the delay in the timing control signal. The timing control signal containing the delay, which is generated by the signal delay line, is used for timing control of supplying the data signals to the driving elements located in the corresponding columns of the matrix.

Since the signal delay line is intersected with the second plurality of signal lines in the same manner as that of the first plurality of signal lines, the amount of the delay of the timing control signal is approximately equal to that of the selection signals generated by the second plurality of signal lines. This means that the data signals are supplied to the driving elements at the optimized timing corresponding to the amount of the delay of the selection signals.

Moreover, even if the amount of the delay of the selection signals is changed by switching the mode or aspect of resolution, the amount of the delay of the timing control signal varies automatically according to the change in the amount of the delay of the selection signals.

As a consequence, the timing to write the image data into the LC cells can be optimized without using any timing controller even if the mode or resolution is changed.

Furthermore, since no complicated driving configuration are required, the configuration of the driver circuits can be simplified.

In a preferred embodiment of the panel according to the first aspect of the invention, the signal delay line has approximately the same electrical characteristic as that of the first plurality of signal lines. In this embodiment, there is an additional advantage that the temporal delay in the timing control signal is substantially or completely equal to that of the selection signals, which leads to complete compensation of the temporal delay in the selection signals.

The electrical characteristic of the signal delay line contains typically the electrical resistance and parasitic capacitance of the signal delay line. However, it may contain any other factors affecting the temporal delay in the timing control signal.

In another preferred embodiment of the panel according to the first aspect of the invention, the signal delay line is located on the input side of the data signals into the second plurality of signal lines. In this embodiment, there is an additional advantage that the amount of the temporal delay of the timing control signal can be substantially or completely equalized to that of the selection signals to be generated by the second plurality of signal lines. This is because the connection line of the signal delay line to a drain driver can be as short as possible.

In a still another preferred embodiment of the panel according to the first aspect of the invention, the driving elements are TFTs. Each of the first plurality of signal lines is electrically connected to gate electrodes of the TFTs located in a corresponding one of the rows of the matrix. each of the second plurality of signal lines is electrically connected to source or drain electrodes of the TFTs located in a corresponding one of the column of the matrix.

In a further preferred embodiment of the panel according to the first aspect of the invention, the timing control signals containing the delay at the second end of the signal delay line has a waveform with approximately the same obtuse rising and falling edges as those of each of the selection signals at corresponding rear ends of the second plurality of signal lines Preferably, each of the first plurality of signal lines is approximately perpendicular to the second plurality of signal lines. It is preferred that the driving elements are TFTs, because TFTs are very popular and they provide high-quality images.

According to a second aspect of the present invention, an LCD device is provided, which is comprised of:

(a) an LCD panel including (a-1) a first plurality of signal lines extending along rows of a matrix and arranged along columns of the matrix;

(a-2) a second plurality of signal lines extending along the columns of the matrix and arranged along the rows of the matrix:

(a-3) LC cells arranged in an array of the matrix; and (a-4) driving elements for driving the respective LC cells; and (a-5) a signal delay line for generating a temporal delay in a timing control signal;

the signal delay line extending along the rows of the matrix and formed not to be electrically connected to the driving elements;

the signal delay line having a first end into which the timing control signal is inputted and a second end from which the timing control signal containing the delay is outputted:

(b) a selection signal source for respectively supplying selection signals to the first plurality of signal lines; and (c) a data signal source for respectively supplying data signals to the second plurality of signal lines.

Each of the selection signals is supplied from the selection signal source to the driving elements located in a corresponding one of the rows of the matrix through a corresponding one of the first plurality of signal lines.

Each of the data signals is supplied from the data signal source to the driving elements located in a corresponding one of the columns of the matrix through a corresponding one of the second plurality of signal lines The timing control signal containing the delay is applied to the data signal source, thereby performing timing control of supplying the data signals to the driving elements located in the corresponding columns of the matrix through the second plurality of signal lines.

With the LCD device according to the second aspect of the present invention, the LCD panel according to the first aspect of the present invention is combined with the selection signal source and the data signal source. Thus, because of approximately the reason as that of the panel according to the first aspect, the timing to write the image data into the LC cells can be optimized without using any timing controller even if the mode of resolution is changed. Also, the configuration of the driver circuits can be simplified.

In a preferred embodiment of the device according to the second aspect of the invention, the signal delay line has approximately the same electrical characteristic as that of the first plurality of signal lines. In this embodiment, there is an additional advantage that the temporal delay in the timing control signal is substantially or completely equal to that of the selection signals, which leads to complete compensation of the temporal delay in the selection signals.

In another preferred embodiment of the device according to the second aspect of the invention, the signal delay line is located on the input side of the data signals into the second plurality of signal lines. In this embodiment, there is an additional advantage that the amount of the temporal delay of the timing control signal can be substantially or completely equalized to that of the selection signals to be generated by the second plurality of signal lines. This is because the connection line of the signal delay line to a drain driver can be as short as possible.

In a still another preferred embodiment of the device according to the second aspect of the invention, the driving elements are TFTs. Each of the first plurality of signal lines is electrically connected to gate electrodes of the TFTs located in a corresponding one of the rows of the matrix. Each of the second plurality of signal lines is electrically connected to source or drain electrodes of the TFTs located in a corresponding one of the column of the matrix. In this embodiment, there is an additional advantage that the advantages of the invention are realized conspicuously.

In a further preferred embodiment of the device according to the second aspect of the invention, the selection signals are respectively supplied to the first plurality of signal lines to be synchronized with the timing control signal that does not contain the delay.

In a still further preferred embodiment of the device according to the second aspect of the invention, the timing control signals containing the delay has a waveform with approximately the same obtuse rising and falling edges as those of each of the selection signals at corresponding rear ends of the second plurality of signal lines.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
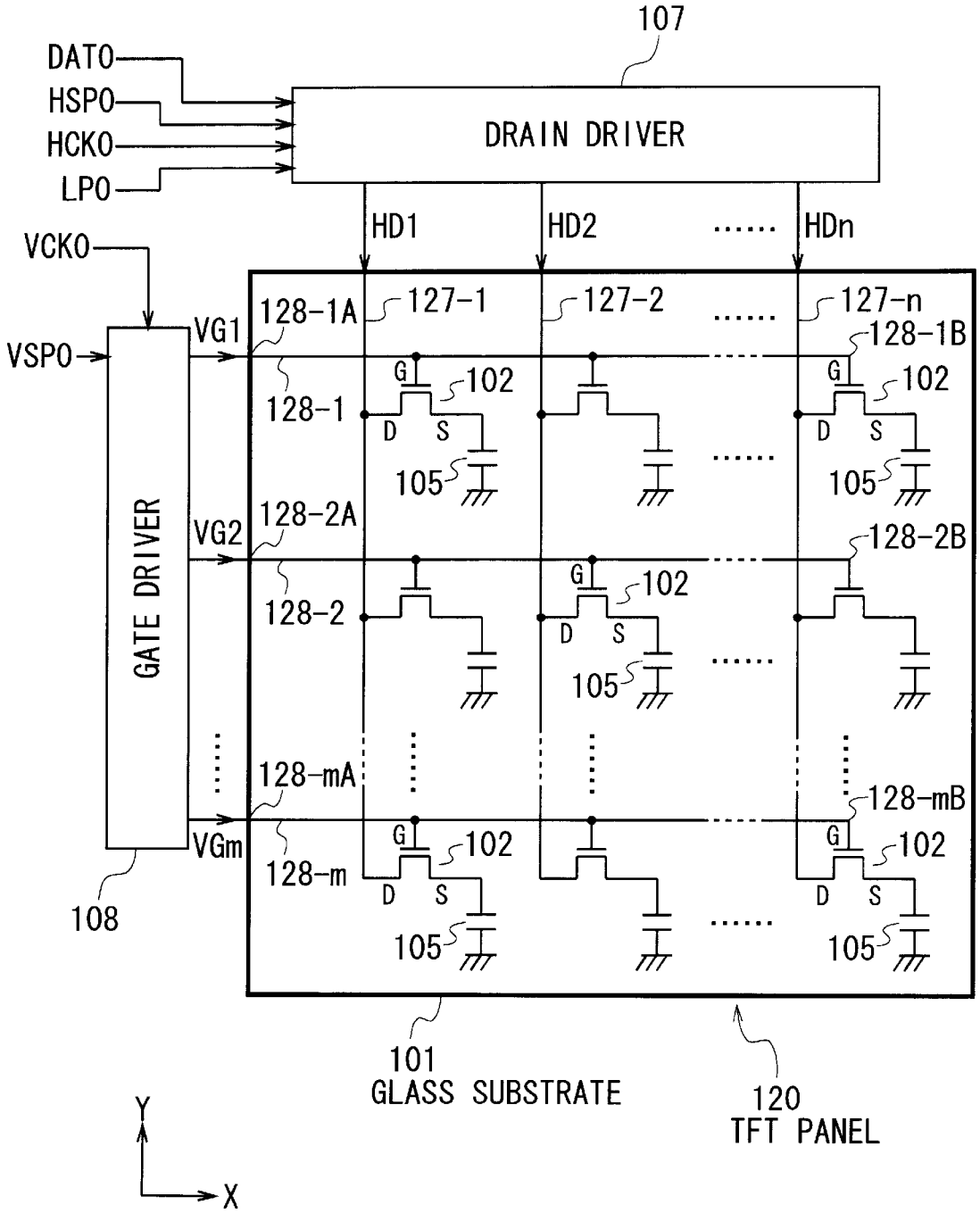
FIG. 1 PRIOR ART
FIG. 1 is a schematic view showing the configuration of a prior-art LCD device.
Figure 2:
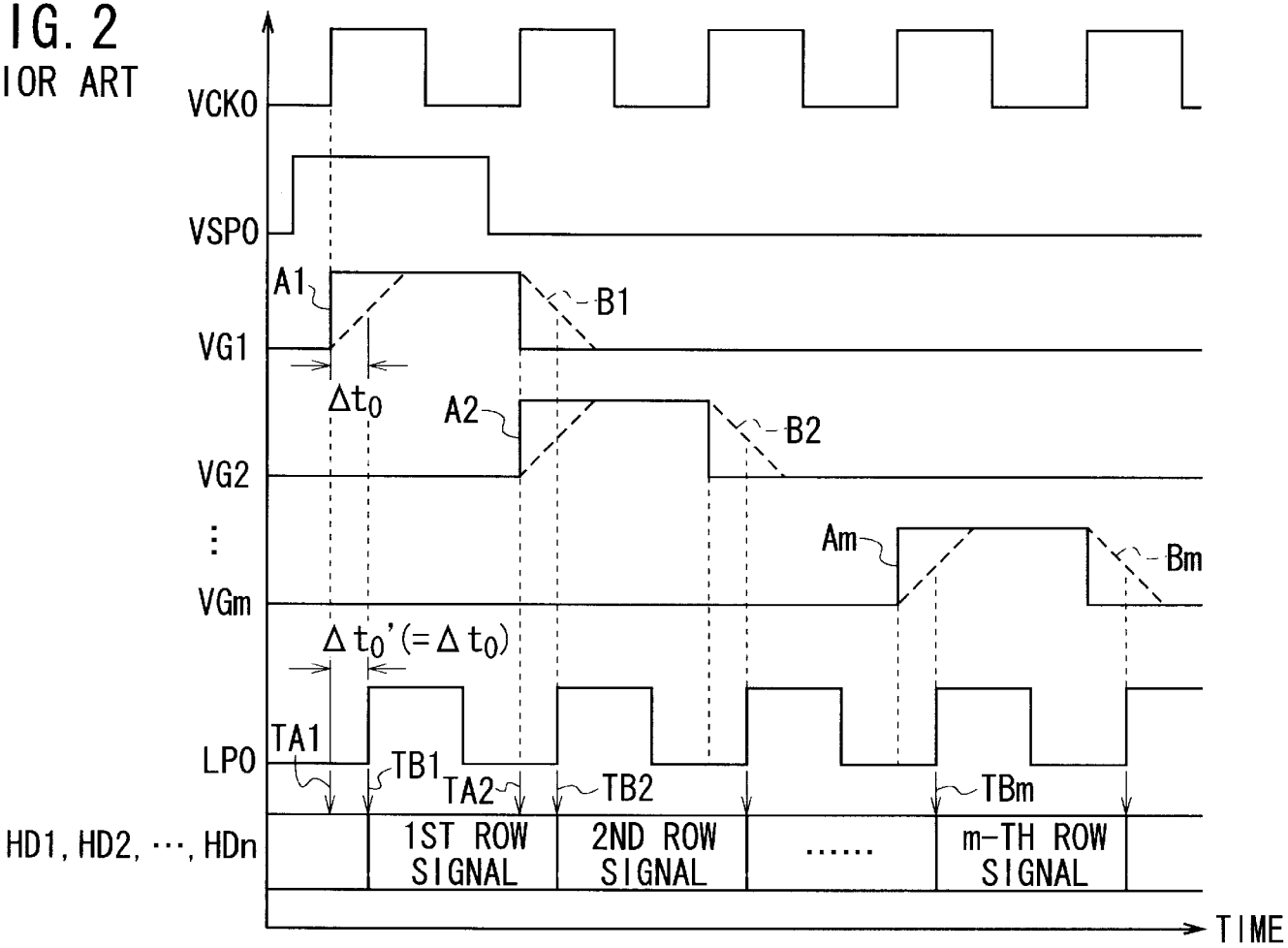
FIG. 2 PRIOR ART
FIG. 2 is a timing diagram showing the operation of the prior-art LCD device shown in FIG. 1.

Preferred embodiments of the present invention will be described in detail below while referring to the drawings attached.

FIRST EMBODIMENT

Figure 3:
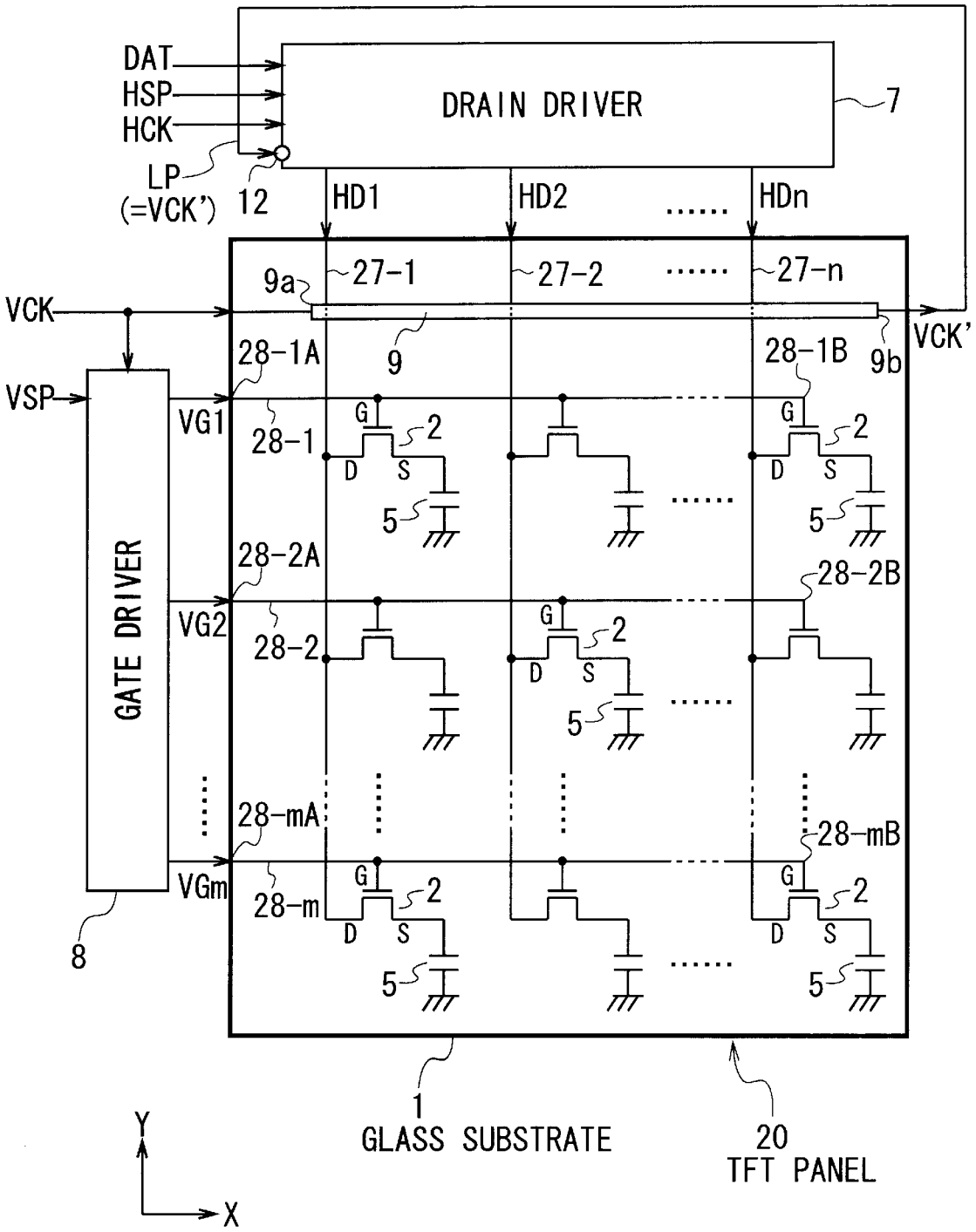
FIG. 3 is a schematic view of an LCD device according to a first embodiment of the present invention.

An LCD device according to a first embodiment has a configuration as shown in FIG. 3.

As seen from FIG. 3, the LCD device is comprised of a TFT panel 20, a drain driver 7 for driving the panel 20, and a gate driver 8 for driving the same.

The panel 20 includes a plurality of LC calls 5 arranged in a matrix array having m rows and n columns. The first to m-th rows of the matrix extend along the X axis in FIG. 3 and arranged along the Y direction in FIG. 3 at equal intervals. The first to n-th columns of the matrix extend along the Y axis in FIG. 3 and arranged along the X direction in FIG. 3 at equal intervals.

A TFT 2 is formed in each of the plurality of LC cells 5. Because of the same reason as described previously, each of the cells 5 is illustrated in FIG. 3 by a symbol of a capacitor. Each cell 5 corresponds to a pixel of the LCD device.

The TFT panel 20 has a transparent glass substrate 1, another transparent glass substrate (not shown), and an LC layer (not shown) formed in the space between the substrate 101 and the opposing substrate.

On the inner surface of the substrate 1, first to m-th gate lines 28-1, 28-2, . . . , and 28-m, first to n-th drain lines 27-1, 27-2, . . . , and 27-n, and the TFTs 2 are formed. The m gate lines 28-1 to 28-m extend respectively along the m rows of the matrix. The n drain lines 27-1 to 27-n extend respectively along the n columns of the matrix. The TFTs 2 are located at the intersections of the gate lines 28-1 to 28-m and the drain line 27-1 to 27-n. Thus, the total number of the TFTs 2 is equal to (m×n).

The gate lines 28-1 to 28-m, which are parallel to each other, are electrically connected to the gate driver 8 located outside the substrate 1 and the panel 20. The drain lines 27-1 to 27-n, which are parallel to each other and perpendicular to the gate lines 28-1 to 28-m, are electrically connected to the drain driver 7 located outside the substrate 1 and the panel 20.

Each of the n drain lines 27-1 to 27-n is electrically connected to the drain electrodes D of the TFTs 2 that are aligned along the corresponding drain line 27-1, 27-2, . . . , or 27-n (i.e., the corresponding column of the matrix). Each or the m gate lines 28-1 to 28-m is electrically connected to the gate electrodes G of the TFTs 2 that are aligned along the corresponding line 28-1, 28-2, . . . , or 28-m (i.e., the corresponding row of the matrix).

The source S of each of the TFTs 2 is electrically connected to one of the two electrodes forming the corresponding LC cell 5, i.e., the corresponding display electrode (not shown) formed on the substrate 1. The other electrodes of the cells 5 (i.e., the common electrode) are electrically connected to a common voltage source, such as the ground.

A signal delay line 9 is formed an the inner surface of the substrate 1 to extend parallel to the gate lines 28-1 to 28-m between the first gate line 28-1 and the drain driver 7. In other words, the line 9 is located on the drain driver side of the substrate 1. The line 9 is perpendicular to (i.e., intersected with) the drain lines 27-1 to 27-n. None of the TFTs 2 are electrically connected to the line 9. The input end 9*a* of the line 9, which is located on the side of the substrate 1 near the gate driver 8, is applied with a vertically-shifting clock signal VCK for determining the scanning timing of the gate driver 8. The output end 9*b* of the line 9, which is located on the opposite side of the substrate 1 to the gate driver 8, is electrically connected to a latch signal terminal 12 of the drain driver 7.

The gate driver 8 is applied with a vertical start signal VSP and the vertically-shifting clock signal VCK. In response to the signals VSP and VCK, the gate driver 8 generates selection signals VG1, VG2, . . . , and VGm to select a corresponding one of the rows of the matrix and then, supplies them to the corresponding gate lines 28-1 to 28-m, respectively.

The drain driver 7 is applied with an image signal DAT, a horizontal start signal HSP, a horizontally-shifting clock signal HCK, and a latch signal LP. The latch signal LP is applied to the driver 7 at its latch terminal 12 through the signal delay line 9. In response to the signals DAT, HSP, HCK, and LP, the drain driver 7 generates pixel data signals HD1, HD2, . . . , and HDn to form images and then, supplies them to the corresponding drain lines 27-1 to 27-n, respectively. The supply or input of the pixel data signals HD1 to HDn is controlled by the latch signal LP.

The LCD device according to the first embodiment as shown in FIG. 1 operates in the following way.

Figure 4:
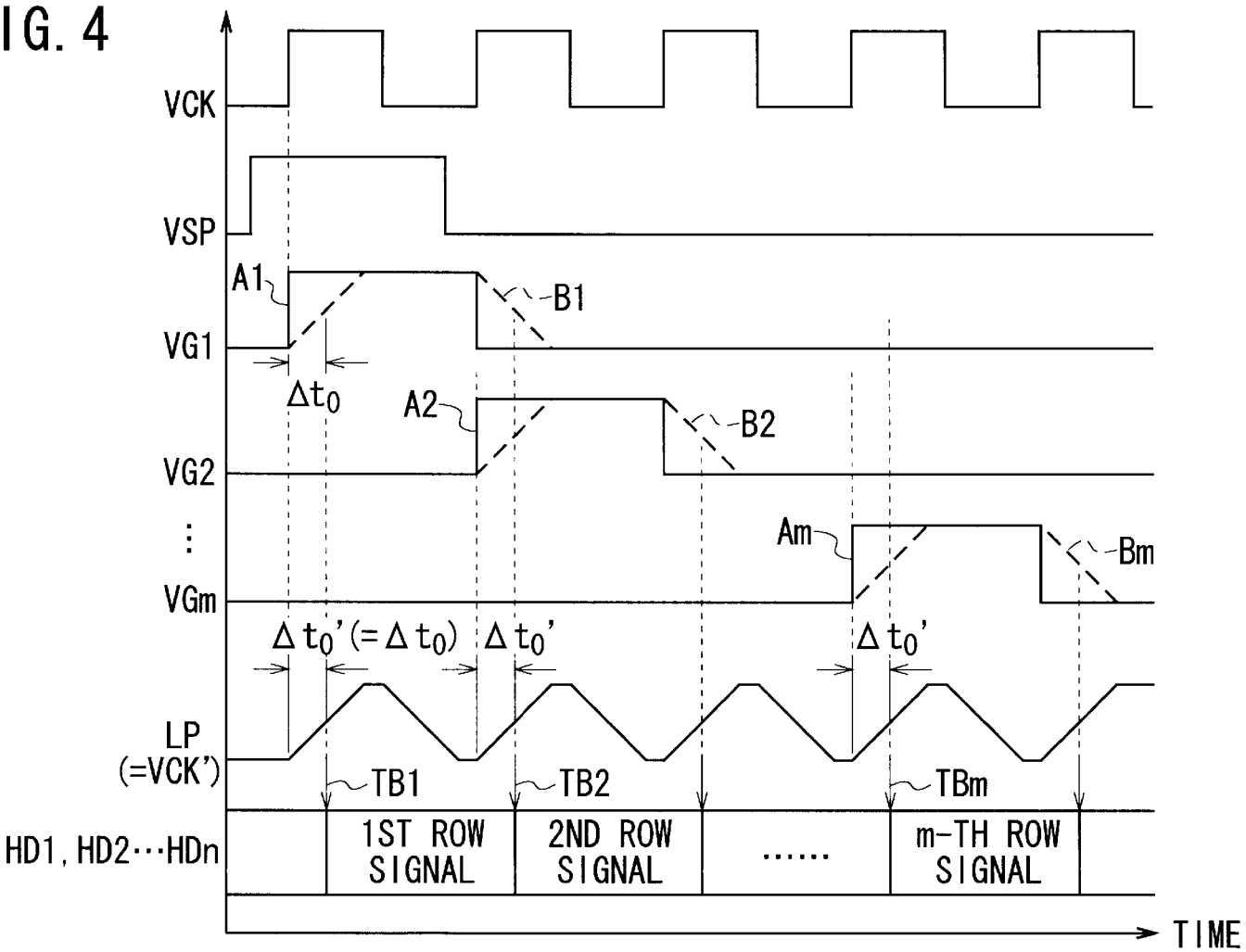
FIG. 4 is a timing diagram showing the operation of the LCD device shown in FIG. 3.

FIG. 4 shows the waveforms of the vertical start signal VSP, the selection signals VG1 to VGm, the latch signal LP, and the pixel data signals HD1 to HDn. In FIG. 4, the solid lines A1, A2, . . . , and Am denote the waveforms of the signals VG1, VG2, . . . , and VGm at the input ends 28-1A, 28-2A, . . . , and 28-mA of the gate lines 28-1, 28-2, . . . , and 28-m, respectively. The broken lines B1, B2, . . . , and Bm denote the waveforms of the same signals VG1, VG2, . . . , and VGm at the output ends 28-1B 28-2B, . . . , and 28-mB of the gate lines 28-1 to 28-m, respectively.

The application of the horizontal start signal HSP to the drain driver 7 triggers off the input of the image signal DAT for the first row of the matrix into the driver 7. The input of the image signal DAT is performed to be synchronized with the application of the horizontally-shifting clock signal HCK. Based on the applied image signal DAT, the drain driver 7 generates the pixel data signals HD1 to HDn for one of the a rows of the matrix and then, supplies them simultaneously to the drain lines 27-1 to 27-n with specific timing, respectively.

On the other hand, the application of the vertical start signal VSP to the gate driver 8 triggers off the generation of the first selection signal VG1. Then, the driver 8 supplies the selection signal VG1 thus generated to the first gate line 28-1 As shown in FIG. 4, the signal VG1 contains a rectangular pulse and therefore, the TFTs 2 applied with the signal VG1 at their gate electrodes G are turned on. Through the TFTs 2 thus turned on, the drain line 27-1 to 27-n are electrically connected to the corresponding LCD cells 5, thereby selecting the cells 5 arranged along the first row of the matrix. Thus, the pixel data signals HD1 to HDn can be supplied to the cells 5 located in the first row of the matrix and the image data contained in the signals HD1 to HDn can be written thereinto.

At this time, the first selection signal VG1 sent from the gate driver 8 is delayed due to the electric resistance of the gate line 28-1-m, the existing parasitic capacitance (i.e., the parasitic capacitance generated by the intersection of the gate line 28-1 with the drain lines 27-1 to 27-n), and so on. In other words, as shown in FIG. 4, since the rising and falling edges of the waveform A1 of the signal VG1 at the output end 28-1B of the gate line 28-1 become obtuse, the signal VG1 has the waveform B1 at the output end 28-1B of the gate line 28-1. This means that the signal VG1 at the output end 28-1B is delayed with respect to the signal VG1 at the input end 28-1A by the period or time difference of $\Delta t_0$. As a result, the so-called gate signal delay time $\Delta t$ appears between the turn-on time of the TFTs 2 located in the first column of the matrix and that of the TFTs 2 located in the n-th column thereof.

With the LCD device according to the first embodiment of FIG. 3, the latch terminal 12 of the drain driver 7 is electrically connected to the output end 9*b* of the signal delay line 9, where the line 9 is intersected with the drain lines 27-1 to 27-n. Thus, the vertical shift clock signal VCK, which is applied to the gate driver 8 and the input end 9*a* of the line 9, is delayed in the same way as that of the first selection signal VG1, resulting in the delayed vertically-shifting clock signal VCK' at the output end 9*b* of the line 9. In other words, the waveform of the delayed vertically-shifting clock signal VCK' has obtuse rising and falling edges as shown in FIG. 4, which creates a temporal delay of $\Delta t'$ with respect to the selection signal VG1 at the input end 28-1A of the first gate line 28-1. The delay $\Delta t'$ is substantially equal to the gate line delay time $\Delta t$. The delayed vertically-shifting clock signal VCK' is applied to the drain driver 7 through its latch terminal 12 as the latch signal LP.

In response to the delayed vertically-shifting clock signal VCK' or latch signal LP, the drain driver 7 outputs simultaneously the pixel data signals HD1 to HDn to the drain lines 27-1 to 27-n at the timing TB1 synchronized with the signal VCK' or LP. Thus, the image data in the signals HD1 to HDn are written into the cells 5 located in the first row of the matrix at the time TB1 when all the TFTs 2 in the first row are turned on.

Subsequently, in the same way as that of the first row, the image signal DAT for the second row of the matrix is inputted into the drain driver 7 to be synchronized with the application of the horizontally-shifting clock signal HCK. Based on the applied image signal DAT, the drain driver 7 generates the pixel data signals HD1 to HDn for the second row of the matrix and then, supplies them simultaneously to the drain lines 27-1 to 27-n, respectively.

The gate driver 8 generates the selection signal VG2 from the vertically-shifting clock signal VCK in the same way as that of the signal VG1 and then, supplies it to the second gate line 28-2.

As seen from FIG. 4, due to the obtuse rising and falling edges of the waveform A2 of the signal VG2 at the output end 28-2B of the gate line 28-2, the signal VG2 has the waveform B2 at the output end 28-2B. This means that the signal VG2 at the output end 28-2B is delayed with respect to the same signal VG2 at the input end 28-2A by the period or time difference $\Delta t$. As a result, the so-called gate delay time $\Delta t$ appears in the signal VG2 also. The signal VCK has a delay time $\Delta t'$ equal to $\Delta t$. Accordingly, the pixel data signals HD1 to HDn are applied by the drain driver 7 to the drain lines 27-1 to 27-n at the timing TB2 to be synchronized with the signal VCK' or LP. Thus, the signals HD1 to HDn are written into the cells 5 located in the second row of the matrix at the time TB2 when all the TFTs 2 in the second row are turned on.

At the time TB2, all the TFTS 2 connected to the first gate line 28-1 are turned off. Therefore, the image data that have been written from the pixel data signals HD1 to HDn into the cells 5 located in the first row are kept unchanged. Moreover, since the signals HD1 to HDn for the second row of the matrix are supplied to the drain lines 27-1 to 27-n at the time TB2 when all the TFTs 2 connected to the second gate line 28-2 are turned off, the data in the signals HD1 to HDn for the second row are not written into the cells 5 located in the first row The above-described processes are repeated for the third to m-th rows of the matrix. The pixel data signals HD1 to HDn for the m-th row are supplied to the drain lines 27-1 to 27-n at the time TBm when all the TFTs 2 connected to the m-th gate line 28-2 are turned off. As a result, the image data in the signals HD1 to HDn for the first to w-th rows are written into all the cells 5, thereby displaying a frame of a desired image.

With the LCD device according to the first embodiment of FIG. 3, the signal delay line 9 extending along the first to m-th rows of the matrix is provided, which is parallel to the gate lines 28-1 to 28-m and perpendicular to the drain lines 27-1 to 27-n. The timing-controlling clock signal VCK is applied not only to the gate driver 8 but also to the input end 9*a* of the line 9, thereby generating the delayed timing-controlling clock signal VCK' (i.e., the latch signal LP) at the output end 9*b* of the line 9. The delayed timing-controlling clock signal VCK' thus generated is used for controlling or adjusting the timing to supply the data signals HD1 to HDn to the TFTs 2 located in the respective columns of the matrix.

Since the signal delay line 9 is intersected with the first to n-th drain lines 27-1 to 27-n in the same manner as that of the first to m-th gate lines 28-1 to 28-m, the amount of the temporal delay of the delayed timing-controlling clock signal VCK' with respect to the initial timing-controlling clock signal VCK is approximately or substantially equal to that of the selection signals VG1 to VGm to be generated by the gate lines 28-1 to 28-m. This means that the date signals HD1 to HDn are supplied to the TFTs 2 at the optimized timing corresponding to the delay amount of the selection signals VG1 to VGm.

Moreover, even if the amount of the delay of the selection signals VG1 to VGm is changed by switching the mode or aspect of resolution, the delay amount of the delayed timing-controlling clock signal VCK' or the latch signal LP varies automatically according to the change in the delay amount of the selection signals VG1 to VGm.

As a consequence, the timing to write the image data contained in the signals HD1 to HDn into the LC cells 5 can be optimized without using any timing controller even if the mode of resolution is changed.

Furthermore, since no complicated driving configuration are not required, the configuration of the driver circuits 7 and 8 can be simplified.

SECOND EMBODIMENT

Figure 5:
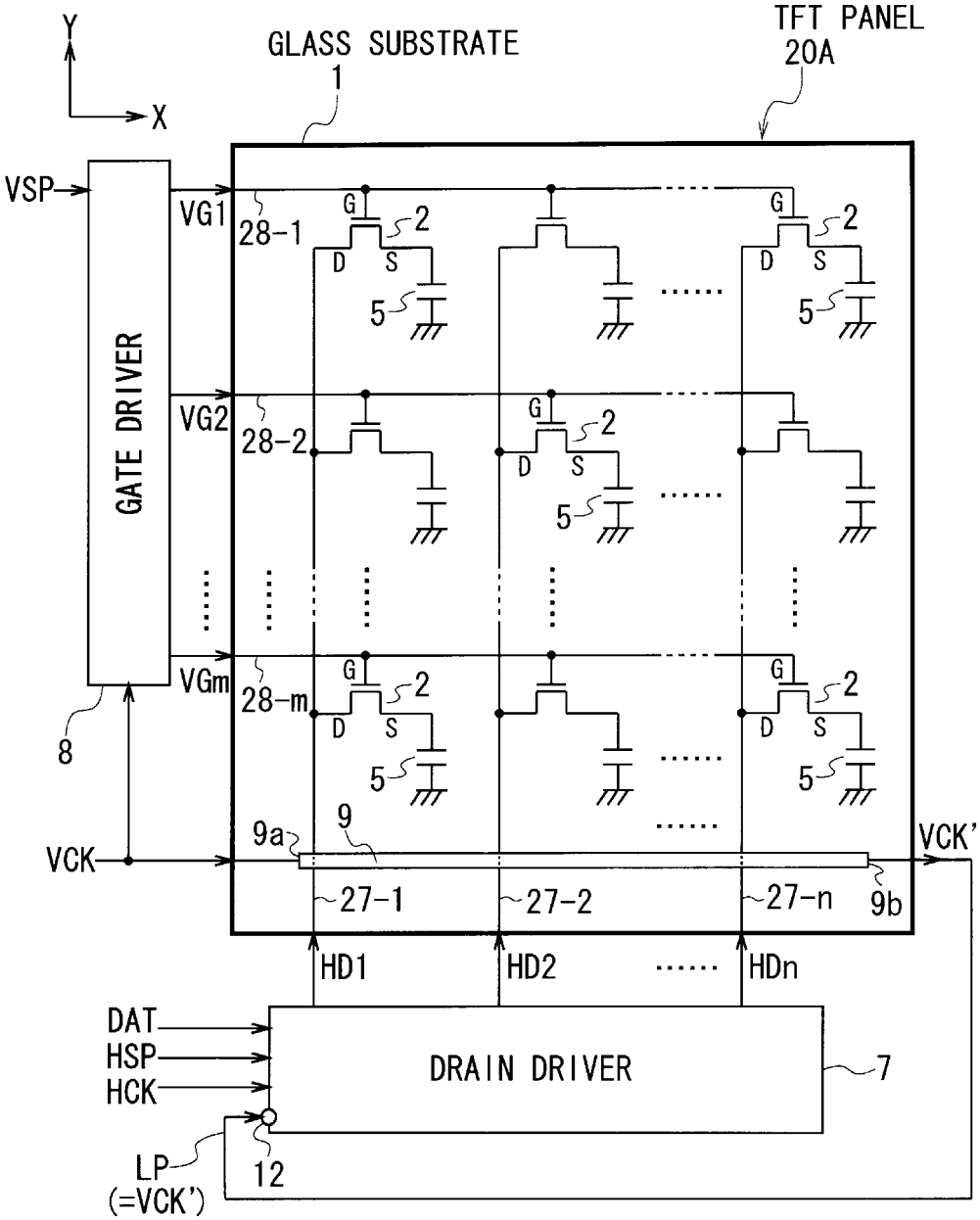
FIG. 5 is a schematic view of an LCD device according to a second embodiment of the present invention.

FIG. 5 shows the configuration of an LCD device according to a second embodiment, which has the same configuration as that of the LCD device according to the first embodiment shown in FIG. 3, except that the drain driver 7 and the signal delay line 9 are placed at different locations from the first embodiment. Therefore, the explanation about the same configuration it omitted here for simplification of description by attaching the same reference symbols as those used in the first embodiment in FIG. 5.

As seen from FIG. 5, the LCD device is comprised of a TFT panel 20A, the drain driver 7 for driving the panel 20A, and the gate driver 8 for driving the same.

Unlike the first embodiment, the drain driver 7 is located below the substrate 1 in FIG. 5 outside the panel 20A. In other words, the driver 7 is located on the opposite side to that of the first embodiment. In response to the location of the driver 7, the signal delay line 9 is located on the lower side of the substrate 1 to be adjacent to the driver 7. The line 9 is perpendicularly intersected with the drain lines 27-1 to 27-n and parallel to the gate lines 28-1 to 28-m.

In general, the drain driver 7 can be located on the upper or lower side of the substrate 1 according to the design of the LCD device. Taking this fact into consideration, it is preferred that the signal delay line 9 is located on the same side as that of the driver 7. In this case, there is an additional advantage that wiring lines connected to the line 9 outside the TFT panel 20A can be as short as possible.

If the length of the wiring lines for the signal delay line 9 is excessively long, the delay period $\Delta t'$ of the delayed vertically-shifting clock signal VCK' or latch signal LP Is greater than the gate line delay time $\Delta t$, which prevents the compensation from being optimized. Unlike this, optimum compensation is ensured in the LCD device according to the second embodiment, because of the possibly-shortened wiring lines connected to the line 9.

It is needless to say that the LCD device according to the second embodiment has the same advantages as those of the LCD device according to the first embodiment.

In the above-described first and second embodiments, TFTs (i.e., three-terminal elements) are used as the driving elements for the LC cells 5. However, the present invention is not limited thereto. MIM elements (i.e., two-terminal elements) serving as diodes may be used for this purpose, in which the waveforms of the signals are properly adjusted according to the known techniques.

Moreover, any other type of driving elements than TFTs and MIM elements may be used for this purpose, if they are applicable to driving so-called active matrix addressing LCD panels.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. An LCD device comprising:

a plurality of gate lines for supplying gate line signals to cells of respective rows of a matrix;

a plurality of data lines for supplying data signals to cells of respective columns of the matrix;

a gate line driver for supplying gate line signals to the gate lines;

a data line driver for supplying data signals to the data lines; and a delay line for generating a temporal delay corresponding to a delay of the gate lines;

the gate line driver and the data line driver receiving a common dock signal, said clock signal being passed through said delay line before being received by said data line driver as a delayed clock signal, and the data line driver comprising a latch coupled to a second end of the delay line, the latch enabling the supply of data signals to the data lines by the data line driver upon receipt of said delayed clock signal through the delay line.

2. The device according to claim 1, wherein the delay line has approximately the same electrical characteristics as the plurality of gate lines.

3. The device according to claim 1, wherein the delay line is located near an input side of the plurality of drain lines.

4. The device according to claim 1, wherein the cells of the matrix comprise TFTs;

wherein each of the plurality of gate lines is electrically connected to gate electrodes of the TFTs; and wherein each of the plurality of data lines is electrically connected to source or drain electrodes of the TFTs.

5. The device according to claim 1, wherein the cells of the matrix comprise transistors, wherein each of the plurality of gate lines is electrically connected to gate electrodes of transistors of a row of the matrix, and wherein each of the plurality of data lines is electrically connected to source or drain electrodes of transistors of a column of the matrix.

6. The device according to claim 1, wherein the delay line extends adjacent to a row of the matrix.

7. The device according to claim 1, wherein the delayed clock signal at an output end of the delay line has a waveform with approximately the same obtuse rising and falling edges as those of gate line signals at corresponding distant ends of the gate lines.

8. The device according to claim 1, wherein the delay line is located on the same side of the panel as the data line driver.

9. A method for controlling the operation of an LCD device, comprising:

simultaneously providing a gate line signal to a gate line of an LCD matrix and providing a clock signal to a first end of a delay line having a delay characteristic that is approximately the same as that of the gate line;

inputting a delayed clock signal received from a second end of the delay line to a data line driver, the inputted delayed clock signal being delayed by the delay line; and enabling the data line driver to produce data signals upon inputting the delayed clock signal.

* * * * *